US008371004B2

(12) United States Patent
Huber et al.

(10) Patent No.: US 8,371,004 B2
(45) Date of Patent: Feb. 12, 2013

(54) UNIVERSAL LACE/CORD LOCK SYSTEM

(76) Inventors: Daniel A. Huber, Denver, CO (US); Bogdan R. Ulatowski, Westminster, CO (US)

( * ) Notice: Subject to any disclaimer, the term of this patent is extended or adjusted under 35 U.S.C. 154(b) by 297 days.

(21) Appl. No.: 12/562,640

(22) Filed: Sep. 18, 2009

(65) Prior Publication Data

US 2011/0067211 A1 Mar. 24, 2011

(51) Int. Cl.
*A43C 7/00* (2006.01)

(52) U.S. Cl. ..... 24/712.2; 24/712.1; 24/132 R

(58) Field of Classification Search ..... 24/712.5–712.7, 24/712.9, 712.4, 712.2, 712.1, 713, 115 R, 24/132 R, 133
See application file for complete search history.

(56) References Cited

U.S. PATENT DOCUMENTS 1,520,716 A * 12/1924 Judd ..... 24/134 P
2,573,806 A * 11/1951 Paterson ..... 403/216
3,765,061 A * 10/1973 Nash ..... 24/134 P
4,102,019 A * 7/1978 Boden ..... 24/712.5
5,572,770 A * 11/1996 Boden ..... 24/136 R
5,894,639 A * 4/1999 Boden et al. ..... 24/115 G
6,185,798 B1 * 2/2001 Ton ..... 24/712.1
6,457,214 B1 * 10/2002 Boden ..... 24/136 R
6,889,407 B2 * 5/2005 Martin ..... 24/136 R
2005/0005477 A1 * 1/2005 Borsoi ..... 36/50.1
2008/0250618 A1 * 10/2008 Stramare et al. ..... 24/712.7

* cited by examiner

*Primary Examiner* — Robert J Sandy
*Assistant Examiner* — Abigail E Morrell

(57) ABSTRACT

A cord locking system that allows easy, rapid, and effective locking/unlocking of any size or type lace in a single handed, swift motion. The device includes a pair of arms that freely rotate about a swivel point within a base housing in a scissors-like motion that lock teeth against the lace by using compression forces from a spring. The arms protrude outside the base for easy disengagement, using a mechanical advantage of leverage to work against the spring force at the teeth on the lace to disengage the lock. Lifting finger upward on the arms to disengage the lock so that the teeth open allows the device to slide up and down the laces toward the preferred location. To lock, let go of the arms as the spring force presses the teeth into the lace at each side of the locking compartment to both lace ends within the device.

8 Claims, 15 Drawing Sheets

UNIVERSAL LACE/CORD LOCK SYSTEM

BACKGROUND OF INVENTION

1. Field of Invention

The invention relates to lace/cord locking systems that can specifically be used with articles of footwear within outdoor recreational sports such as snowboard boots but also cycling, hiking, hockey skates, and wakeboarding equipment.

2. Discussion of Related Art

There are many different lace locking devices in the market, such as Lacers, Yankz, Crossbow Sure Lock, Lacelock, the Burton Lace Lock, Hyperlite State wakeboard bindings, the Boa Lacing System, and many more. Most of these systems include a specific lace with the product because the type of locking mechanism requires a precise size and a certain material of the lace for the product to work properly. They have a single tooth-like contact point that can easily snag the lace, causing permanent damage. The locking mechanism poorly holds into place, with the assumption that the tightness from the shoe/boot keeps the plunging mechanism in a locking position. After minutes of use, these mechanisms eventually work free with little to no holding force. There are other devices that work with a spring action but at a single contact point with no leverage advantage so the spring is either too weak to lock tight or too tight to easily loosen. Other devices that do lock require more complicated locking procedures so that it is not easy to tighten or release either by force or requiring both hands. Lastly, a more recent concept in snowboarding and wakeboarding equipment is the cable ratchet system called Boa Lacing System. This product includes a metal cable as your lace and locks by rotating a knob that intertwines the cable inside. To release, press the knob. This concept is quite expensive, requires a metal cable that digs into your skin, and can get tangled and damaged that is almost impossible to repair.

SUMMARY OF INVENTION

The function of this apparatus is to lock shoe laces quickly and securely without the necessity of tying them by hand. With the adjustable interlocking system, this product uniquely offers flexibility so it can be used on any size/type of lace and not be dependent on specific size or material of the lace. The user only needs to squeeze the apparatus' arms together, then thread the laces through the base openings, after laces are threaded inside apparatus, user needs to squeeze arms together again, grasp both laces in one hand and then slide apparatus toward the shoe, after arms are released shoe laces will be efficiently and durably secured in place, small size of the apparatus allows to be tack inside of the boots. This product can theoretically be used on any lace material, any size of lace, and just about any lace locking application with the ease of one hand.

This apparatus can be used by an original OEM to implement within their product, sold through retail channels direct to the customer as an accessory, used by repair or service rental shops, or to be used as a replacement to any other shoe laces locking devices.

DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing.

The drawings are as follows.

DETAILED DESCRIPTION

Figure 1A:
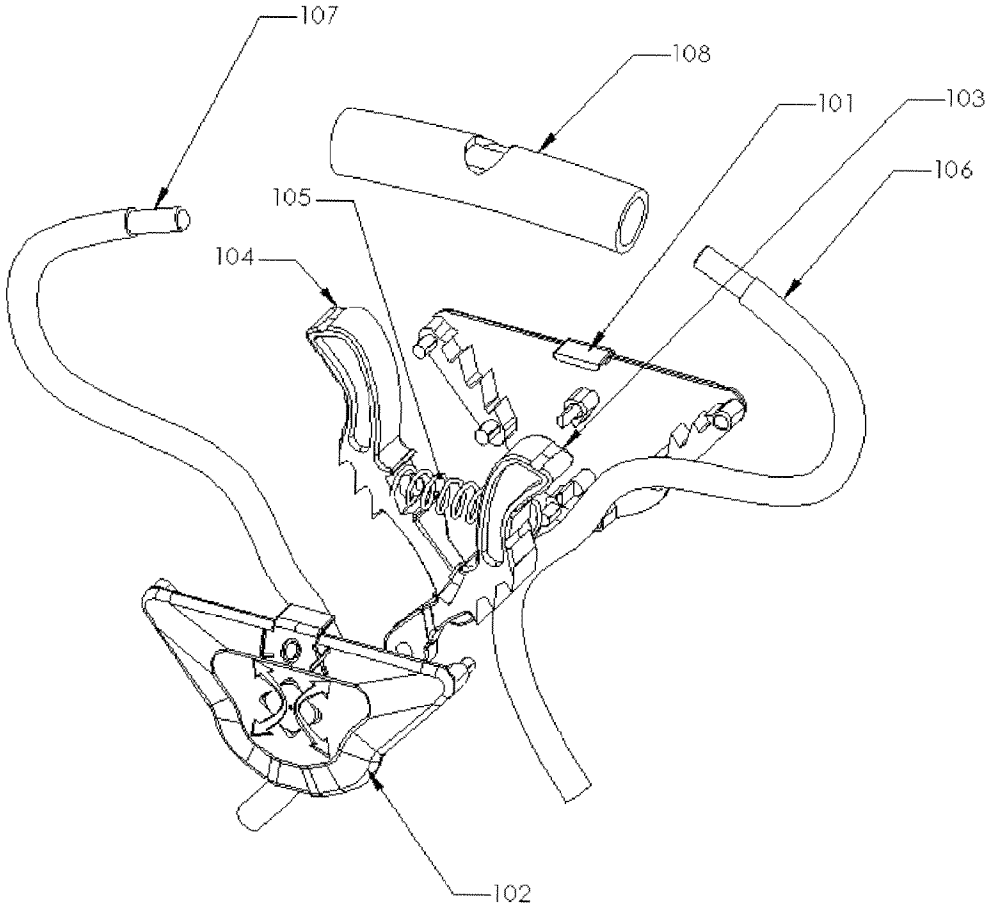
FIG. 1A is an exploded view of the components within the locking device in a "V-shaped" concept

Embodiments of the invention described herein are not limited in their application to the details of construction and the arrangement of components set forth in the following description or illustrated in the drawings. Other embodiments are capable of being practiced or carried out in different ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

In FIG. 1A, the drawing includes all of the exploded parts for the assembly of a V-shaped lock configuration: the symmetrical and identical bases (101, 102), the symmetrical and identical arms (103, 104), one compression spring (105), a complete shoe lace—right side and left side (106, 107) from a single boot/shoe, and the pull tool (108). Each end of the shoe lace (106, 107) would run through the lock lace device that includes the base parts (101, 102)/arms (103, 104)/spring (105) and up to the pull tool (108). The two base parts (101, 102) snap fit together and the spring (105) forces the two arms (103, 104) against the teeth compartment within both base parts, locking the shoe lace (106, 107) motion.

Figure 1B:
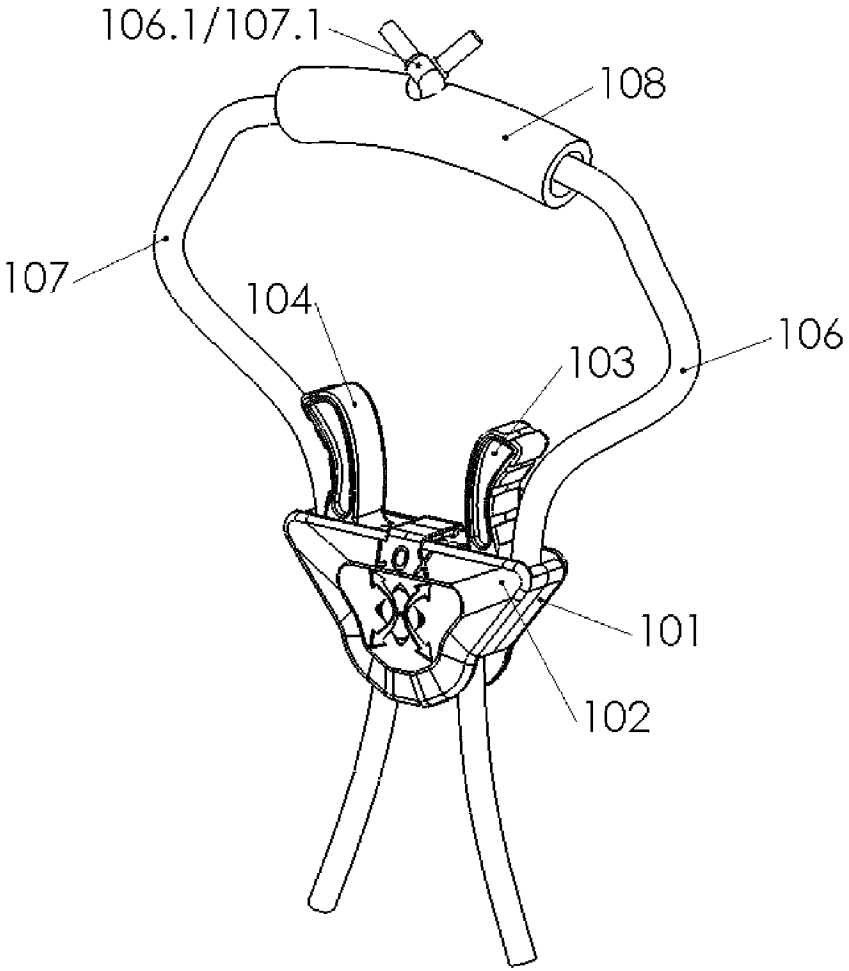
FIG. 1B is an assembly drawing of the components within the locking device in a "V-shaped" concept

In FIG. 1B, the drawing includes all of the exploded parts from FIG. 1A but in a complete assembly. The two identical arms (103, 104) cross each other and fit inside the two mounting base shells (101, 102), with a compression spring (105)—not visible. Each end of the shoe lace (106, 107) runs through each side of the locking device as shown from the point of the V-shaped base to the top/outer part of the base parts. Each end of the lace (106, 107) runs through the inside of the pull tool (108), up through the center hole of the pull tool, and the laces are tied together in a knot (106.1, 107.1). The pull tool is used to tighten the desired position of the locking V-shaped device. The locking device is locked down by the force of the spring with the teeth grabbing each side of the lace. The overall dimension of the locking device assembly is 2 in wide by 1.5 in tall and approx ¼ in thick.

Figure 1C:
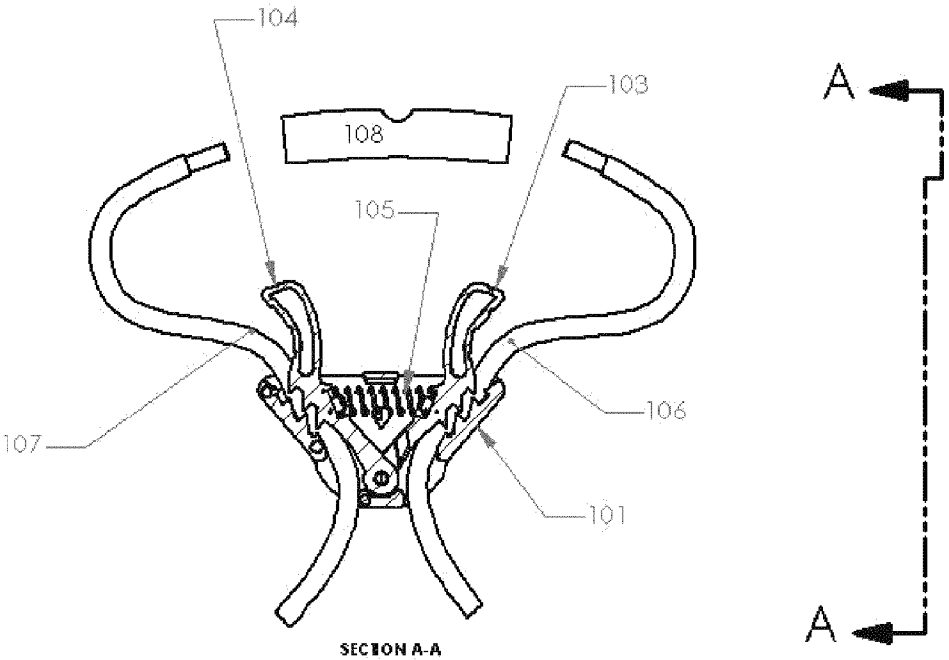
FIG. 1C is a sectional view of the V-assembly concept with the arms and the laces

In FIG. 1C, the drawing involves a cross-section of the assembly locking device from FIG. 1B showing the inside view of the base shell. The two identical arms (103, 104) cross mount within the base piece (101). The compression spring (part 105) force the teeth of the two arms (103, 104) against the shoe lace (106, 107) to lock it against the teeth of the base (101) within the shoe lace channel. The teeth are oriented in a way to prevent motion of the shoe lace upward from loosening the shoe lace but allowing the motion to move upward to tighten the shoe lace while the arms are locked. To easily disengage the locking mechanism, use the force of your fingers as leverage from the rotation of the post of the base (101) to the ends of the arms (103, 104). The shape and material of both arms (103, 104) allow the user to easily grab the part to disengage with two fingers from one hand by pulling the device upward, toward the user. To tighten, pull arms together within the locking device, push away while pulling the pull tool (108) and let go of the arms to engage the spring that locks the device at each end of the lace. The V-shaped concept takes advantage of three things; 1) the lever arm, 2) a wedge/pinch turn at base exit, and 3) the forces against the base teeth. The lever arm is maximized in the V-shape from the ends of the arms (103, 104) to the tip of the V-shape at the rotation of the post of the base (101). The wedge feature occurs naturally as the shoe laces (106, 107) bend at a tight 90 degree or more from the point of the V-shaped base outward towards the shoe. This outward force of the shoe lace, presses against the base teeth, and works with the spring force and the two arms; which in turn aids in the locking concept.

Figure 1D:
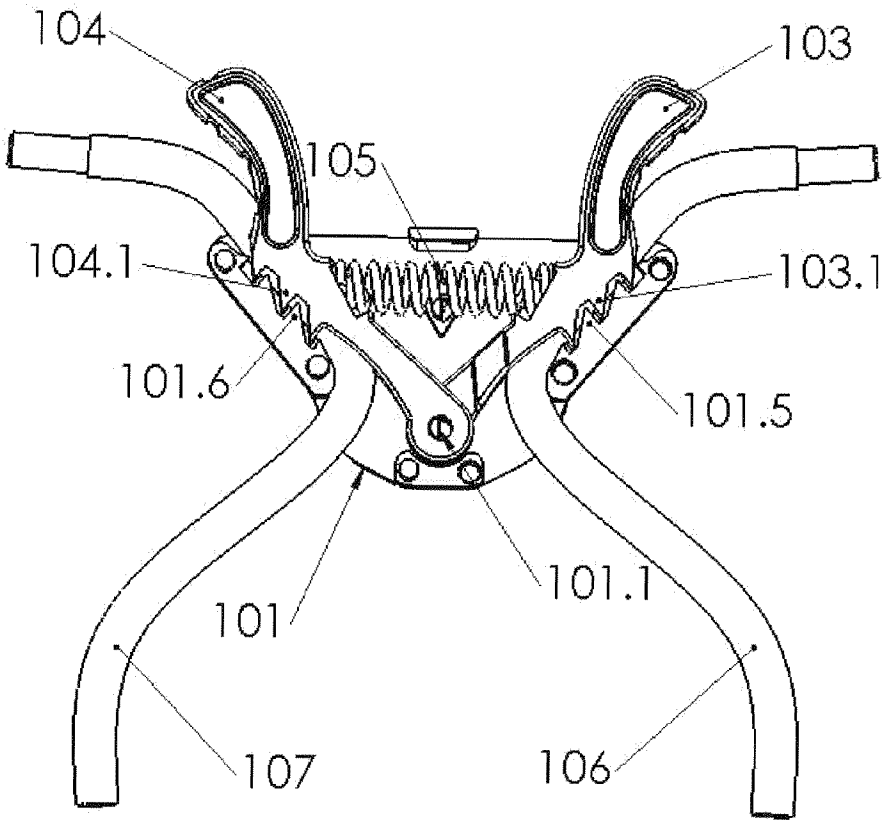
FIG. 1D is a sectional view of the V-assembly with the arms spring forced into a locking position on the laces

In FIG. 1D, the drawing demonstrates the full locking position of the device as the force from the spring (105) is pressing the two arms (103, 104) against the base (101, 102—not shown) with the shoe lace ends (106, 107) locked in between. The arms' motion may rotate around the pivot point of the base post (101.1). This force can be controlled by the spring parameters such as the material, spring OD, material OD, and spring length. The teeth from the arms (103.1, 104.1) and base (101.5, 101.6) are designed to be intertwined with multi-contact points against the laces (106, 107) so that it will not pinch/knot at one location but still lock motion. The compression spring (105) force the teeth of the two arms (103.1, 104.1) against the shoe lace (106, 107) to lock it against the teeth of the base (101.5, 101.6) within the shoe lace channel. To tighten this lock, push apart the arms by pushing downward with your fingers against the arms while pulling the pull tool (108). Simply let go of the arms to engage the spring that locks the device at each end of the lace (106, 107).

Figure 1E:
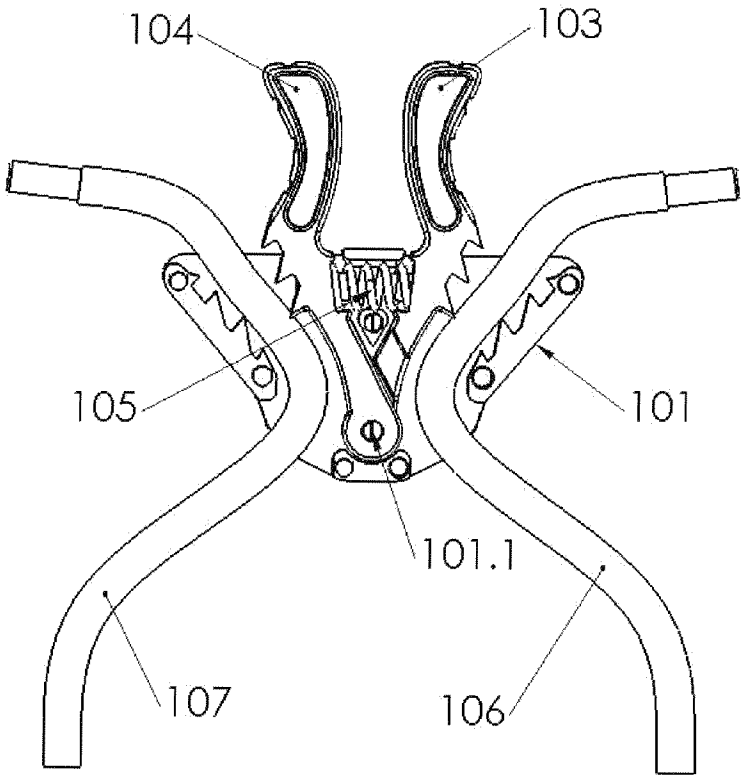
FIG. 1E is a sectional view of the V-assembly with the arms disengaged allowing the laces to slide smoothly within the device

In FIG. 1E, the drawing demonstrates the full disengagement of the device as the arms (103, 104) open up against the spring (105) within the base (101, 102—not shown) allowing the shoe lace ends (106, 107) to easily slide within the locking device. The mechanical advantage of the lever arm from the rotation of the base at the lever post (101.1) to the ends of the arms (103, 104) allow the user to easily disengage the locking device and press against the compression force of the spring (105). To easily disengage the locking mechanism, the arms use leverage with the simple force of your fingers from the rotation of the base at the lever post (101.1) to the ends of the arms (103, 104). The shape and material of the arms (103, 104) allow you to easily grab the part to disengage with two fingers of your hand by pulling the device upward, toward yourself. Based on the dimensions for this specific example, the open channel allows the laces to be up to 5 mm in OD width.

Figure 2A:
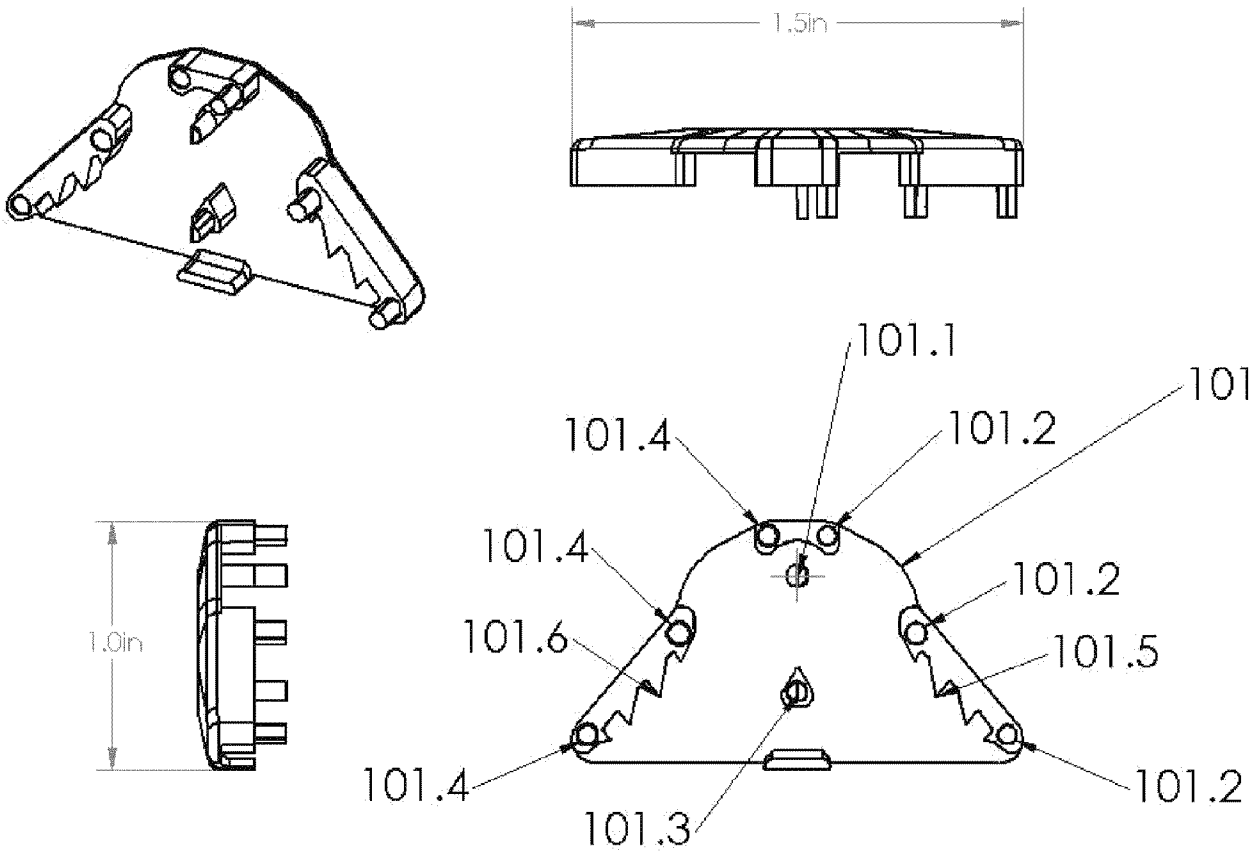
FIG. 2A is a detailed view of the base

In FIG. 2A, the drawing includes a detailed model of the base (101) from the V-shaped concept. This part includes the lever post (101.1), the 3 full pins (101.2), the 2 half pins (101.1, 101.3), the mounting holes (101.4), and the base teeth (101.5, 101.6). The two base parts are identical mirror image of each other and snap together 3 full pins (101.2), into the opposite end holes (101.4) and the 2 half pins (101.1, 101.3) pair up within each other. The base unit can either be press fit together with an arbor press or can even be ultrasonically welded or glued together for a true form fit. The outer base shell that is exposed after assembly would include the LOX locking device logo imprinted in the plastic.

Figure 2B:
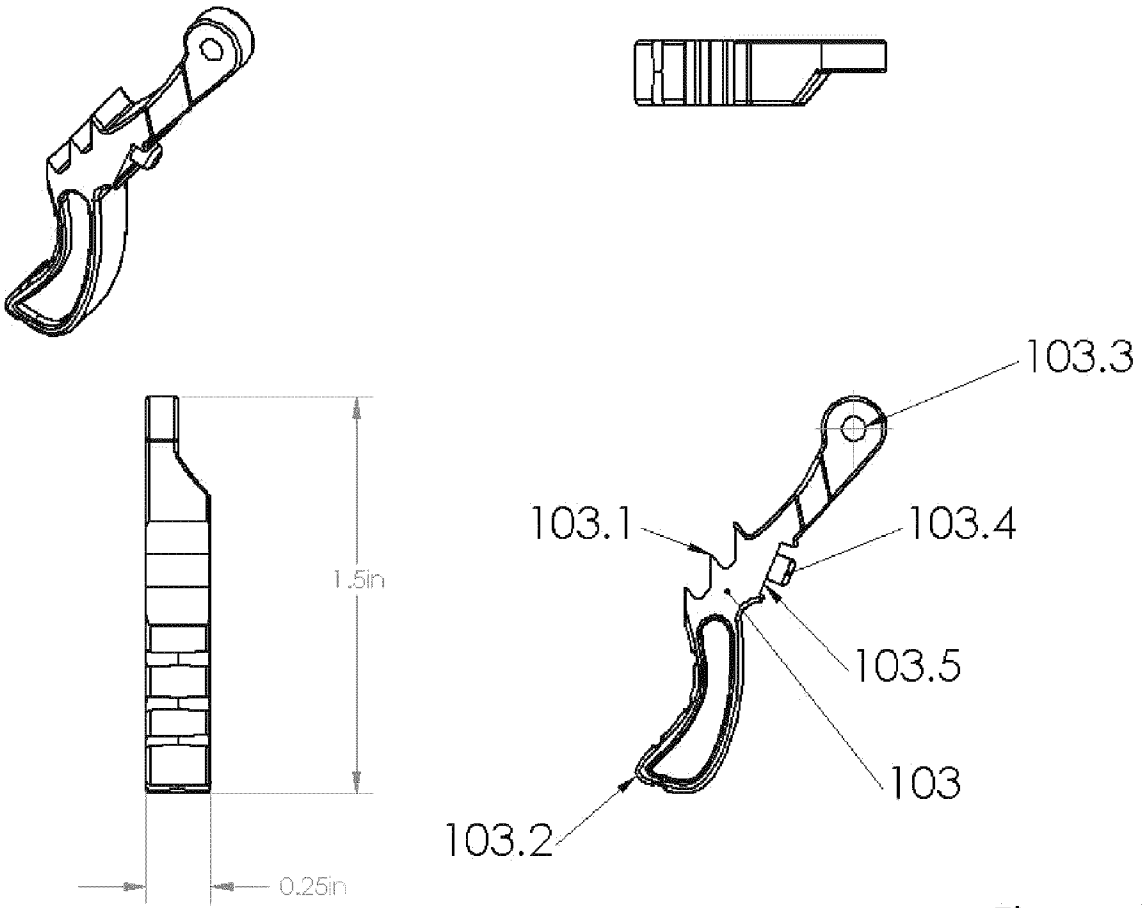
FIG. 2B is a detailed view of the arm

In FIG. 2B, the drawing includes a detailed model of the arm (103) from the V-shaped concept. This part includes the arm teeth (103.1), the end of the arm (103.2), the rotational hole of the arm (103.3), the spring mounting post (103.4), and the spring end surface (103.5). The arms' teeth (103.1) must be oriented and positioned in a way to align properly with the base teeth. The teeth tips may need to be slightly chamfered with a radius so the teeth aren't so sharp to cut into or knot the lace. Plus, a radius would be required for the manufacturing tool in production. The end of the arm (103.2) could be overshot molded with a rubber soft Shore durometer plastic shell to add comfort to your fingers. The leverage from the rotation of the arm (103.3) to the end of the arm (103.2) offers a mechanical advantage to lock and unlock the spring force at the arm surface (103.5). The rotational hole (103.3) would need to be a perfectly round hole for smooth rotational characteristics. The spring mounting post (103.4) allows for easy installation of the spring during the fabrication process top hold it in place between the two arms before the base parts are connected together.

Figure 2C:
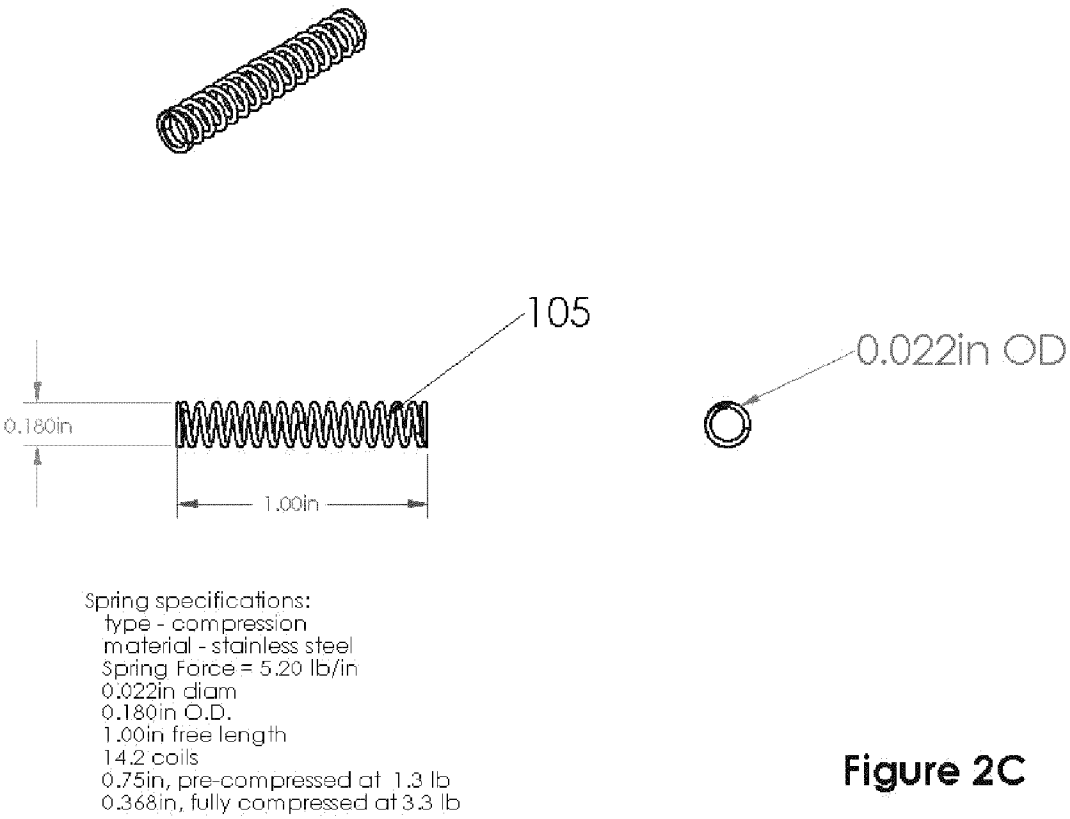
FIG. 2C is a detailed view of the compression spring

In FIG. 2C, the drawing includes a detailed model of the spring (105) from the V-shaped concept. This part includes the critical dimensions such as the spring length, the spring OD, the material, and the material OD. With all of these parameters, the spring force is able to be calculated. For this example, we choose the spring length to be 1.0 inch, spring OD to be 0.180 inch, material stainless steel (prevent rust in wet conditions such as water and snow), and material OD to be 0.022". This gives us a pre-force of 1.3 lbs at the compressed length of 0.75 inch and maximum compressed force of 3.3 lbs at the fully compressed length of 0.368 inch.

Figure 2D:
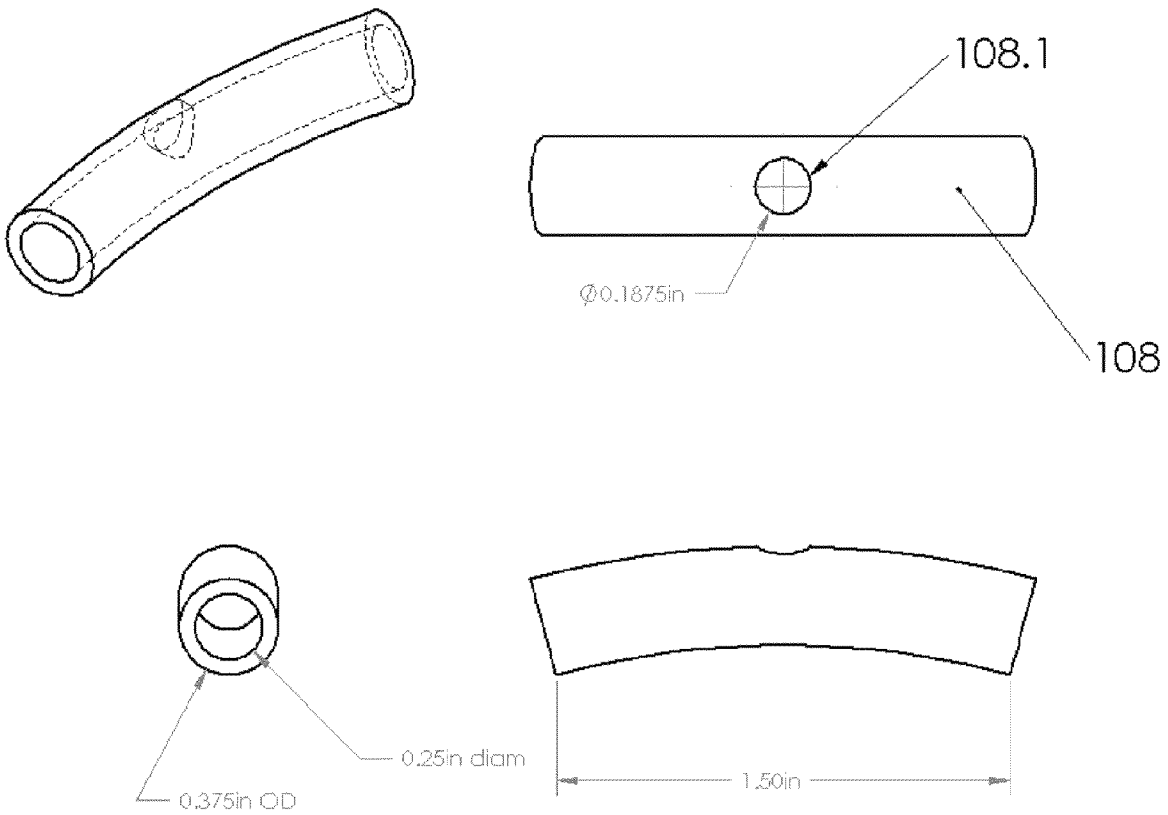
FIG. 2D is a detailed view of the pull tool

In FIG. 2D, the drawing includes a detailed model of the pull tool (108) from the V-shaped concept. The pull tool is a component that ties the end of the shoe laces together for easy pulling action for tightening the locking device. For this specific example, the part is a vinyl clear tubing, 0.375 inch diameter, ⅛ inch thick with a 0.25 inch diameter inner hole, overall length of 1.5 inch, and a 0.1875 inch diameter hole at the top (108.1). The end of each shoe lace enters each side of the 0.25 inch inner diameter hole of the pull tool, meeting at the center where both lace ends exit the both the 0.1875 inch diameter hole at the top (108.1) and tied into a knot.

Figure 3A:
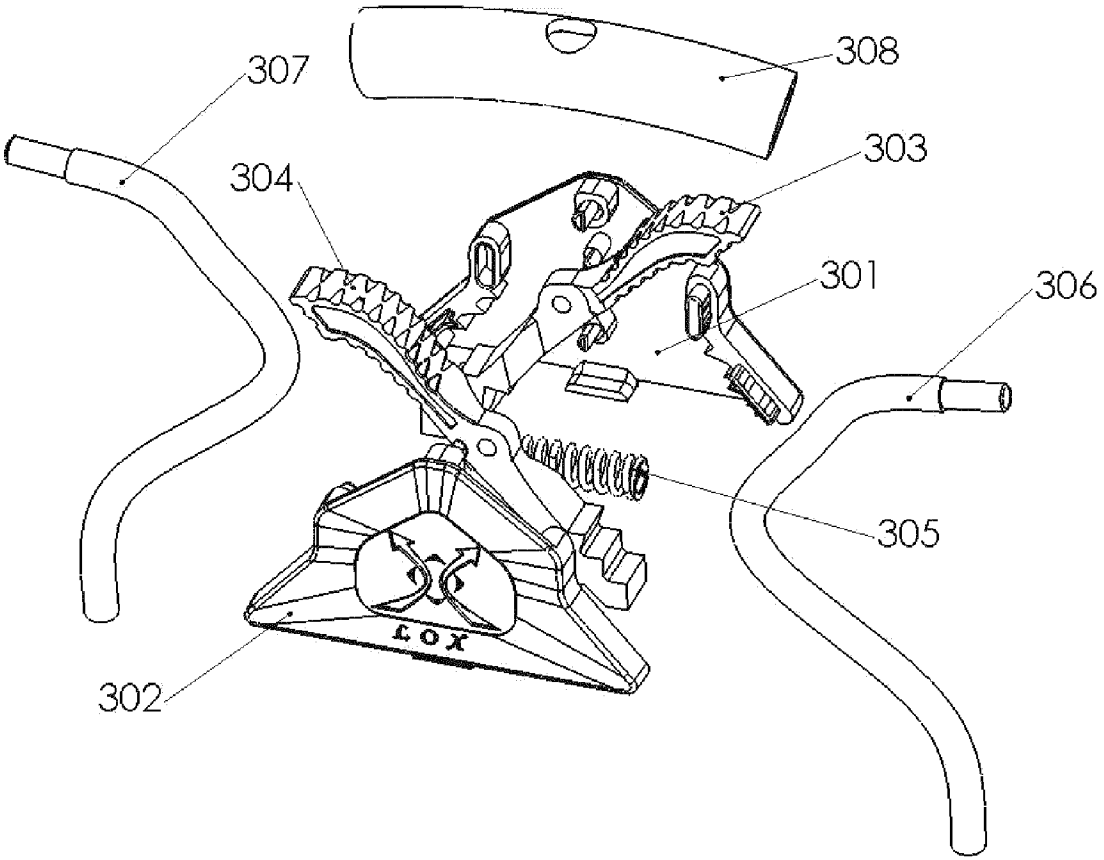
FIG. 3A is an exploded view of the components within the locking device in an alternate "X-shaped" concept

In FIG. 3A, the drawing includes all of the exploded parts for the assembly of a X-shaped lock configuration: the symmetrical and identical bases (301, 302), the symmetrical and identical arms (303, 304), one compression spring (305), a complete shoe lace—right side and left side (306, 307) from a single boot/shoe, and the pull tool (308). Each end of the shoe lace (306, 307) would run through the lock lace device that includes the base parts (301, 302)/arms (303, 304)/spring (305) and up to the pull tool (308). The two base parts (301, 302) snap fit together and the spring (305) forces the two arms (303, 304) against the teeth compartment within both base parts, locking the shoe lace (306, 307) motion. The main difference between the V-shaped lock and this X-shaped lock example is the left arm (304) presses against the right lace (306) and the right arm (303) presses against the left lace (307), crossing like a scissors configuration. FIG. 1 and FIG. 3 are just a couple of examples in which the arms may be oriented in rotation within the base parts and this patent design can be configured in these examples or many variations thereof.

Figure 3B:
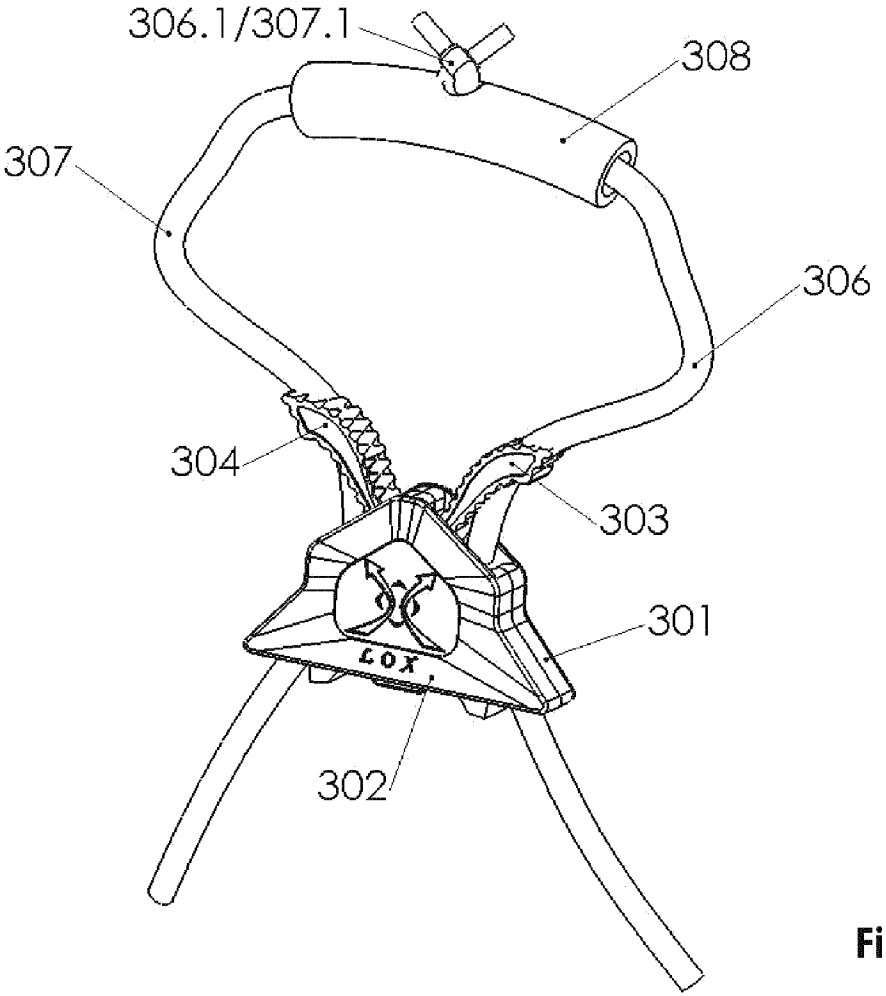
FIG. 3B is an assembly drawing of the components within the locking device in an alternate "X-shaped" concept

In FIG. 3B, the drawing includes all of the exploded parts from FIG. 3A but in the complete assembly. The two identical arms (303, 304) cross each other and fit inside the two mounting base shells (301, 302), with a compression spring (305)—not visible. Once again, the arms can be squeezed inside together to loosen the lock, and pressed outward/downward to tighten the lock for both the X-lock and V-lock configurations. Each end of the shoe lace (306, 307) runs through each side of the locking device as shown from the point of the X-shaped base to the top X-shaped base. Each end of the lace (306, 307) runs through the inside of the pull tool (308), up through the center hole of the pull tool, and the laces are tied together in a knot (306.1, 307.1). The pull tool is used to tighten the desired position of the locking X-shaped device. The overall dimension of the locking device assembly is approx 1¾ inch wide by 1⅜ inch tall and ⅜ inch thick.

Figure 3C:
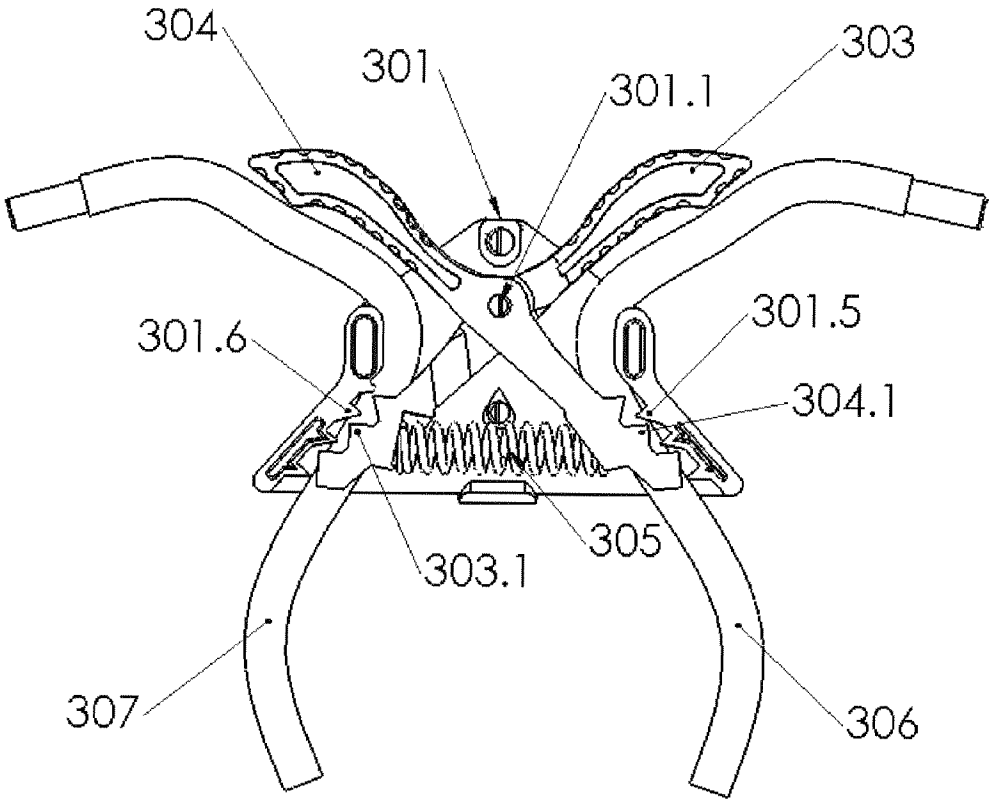
FIG. 3C is a sectional view of the X-assembly with the arms spring forced into a locking position on the laces

In FIG. 3C, drawing demonstrates the full locking position of the device as the force from the spring (305) is pressing the two arms (303, 304) against the base (301, 302) with the shoe lace ends (306, 307) locked in between. The arms' motion may rotate around the pivot point of the base post. This force can be controlled by the spring parameters such as the material, spring OD, material OD, and spring length. The teeth from the arms (303.1, 304.1) and base (301.6, 301.5) are designed to be intertwined with multi-contact points against the laces (306, 307) so that it will not pinch/knot at one location but still lock motion. The compression spring (105) force the teeth of the two arms (303.1, 304.1) against the shoe lace (306, 307) to lock it against the opposite end of the base's teeth (301.6, 301.5) within the shoe lace channel. To tighten this lock, push apart the arms by pushing downward with your fingers against the arms while pulling the pull tool (308). Simply let go of the arms to engage the spring that locks the device at each end of the lace (306, 307). The X-lock configuration is similar to a scissors motion but with the locking force due to spring is pressed outward against the base with the arms cross interlocked from the base lever arm.

Figure 3D:
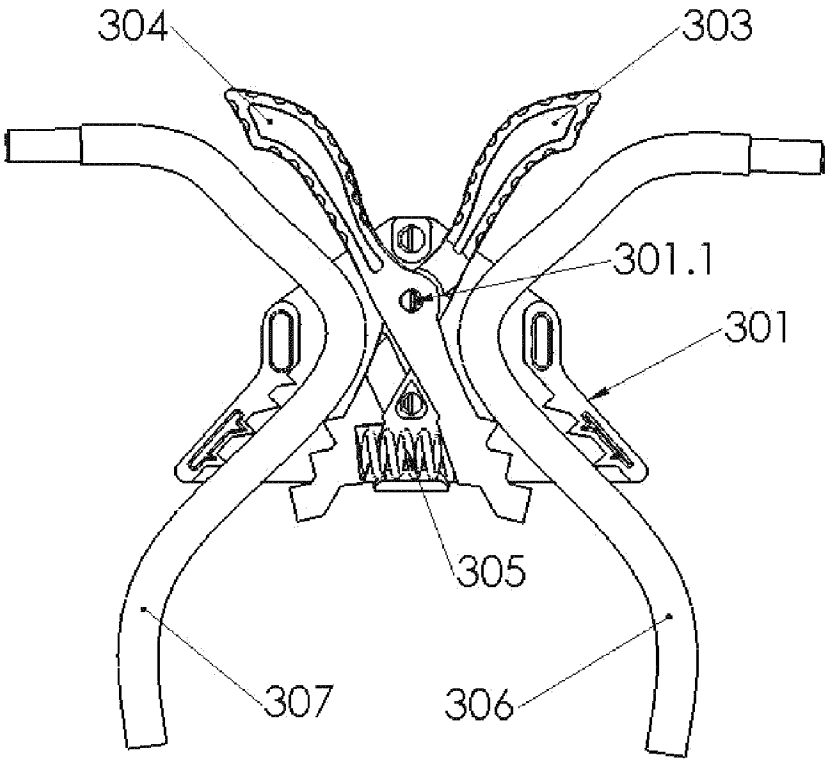
FIG. 3D is a sectional view of the X-assembly with the arms disengaged allowing the laces to slide smoothly within the device

In FIG. 3D, the drawing demonstrates the full disengagement of the device as the arms (303, 304) open up against the spring (305) within the base (301, 302—not shown) allowing the shoe lace ends (306, 307) to easily slide within the locking device. The mechanical advantage of the lever arm from the rotation of the base at the lever post (301.1) to the ends of the arms (303, 304) allow the user to easily disengage the locking device and press against the compression force of the spring (305). To easily disengage the locking mechanism, the arms use leverage with the simple force of your fingers from the rotation of the base at the lever post (301.1) to the ends of the arms (303, 304). The shape and material of the arms (303, 304) allow you to easily grab the part to disengage with two fingers of your hand by pulling the device upward, toward yourself. In this motion, it is similar to cutting with scissors, squeezing the arms (303, 304) inward as they cross disengage with outer base teeth (301, 302—not shown).

Based on the dimensions for this specific example, the open channel allows the laces to be up to 5 mm in OD width.

Figure 4A:
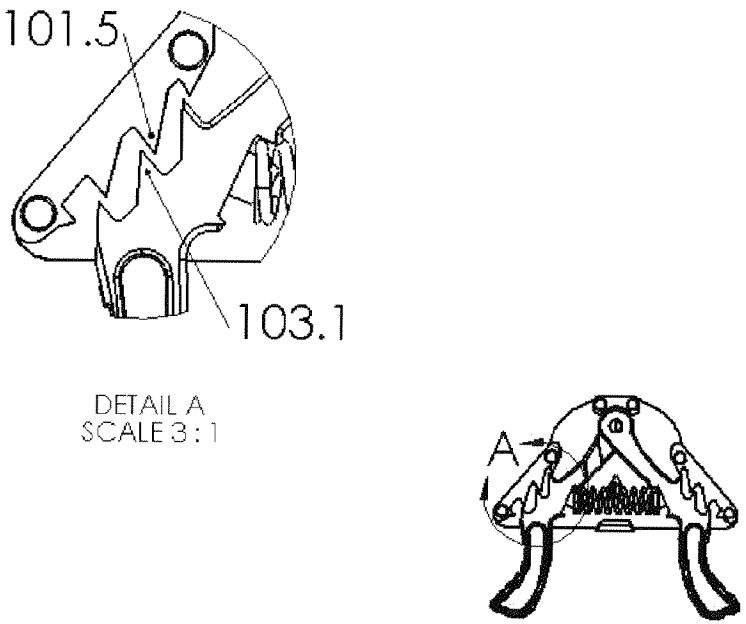
FIG. 4A is an intertwined configuration of the teeth alignment between the arm and the base.

In FIG. 4A, the drawing demonstrates the teeth orientation configuration between the arm and the base. The teeth are positioned in a way to intertwine the tips of the teeth and prevent downward motion away from the V-lock rotation post (top position near the shoe/boot). Notice the teeth are aligned like a zig-zag puzzle without point to point contact to prevent a knot in the lace but still prevent a sliding motion. The drawing at Detail A is zoomed in a scale of 3:1 to show the detail of a configuration between the arm teeth (103.1) and the base teeth (101.5). Based on engineering test results, this configuration proved to be the optimal in terms of holding force (up to 13 lbs) and preventing knots in the lace/cord.

Figure 4B:
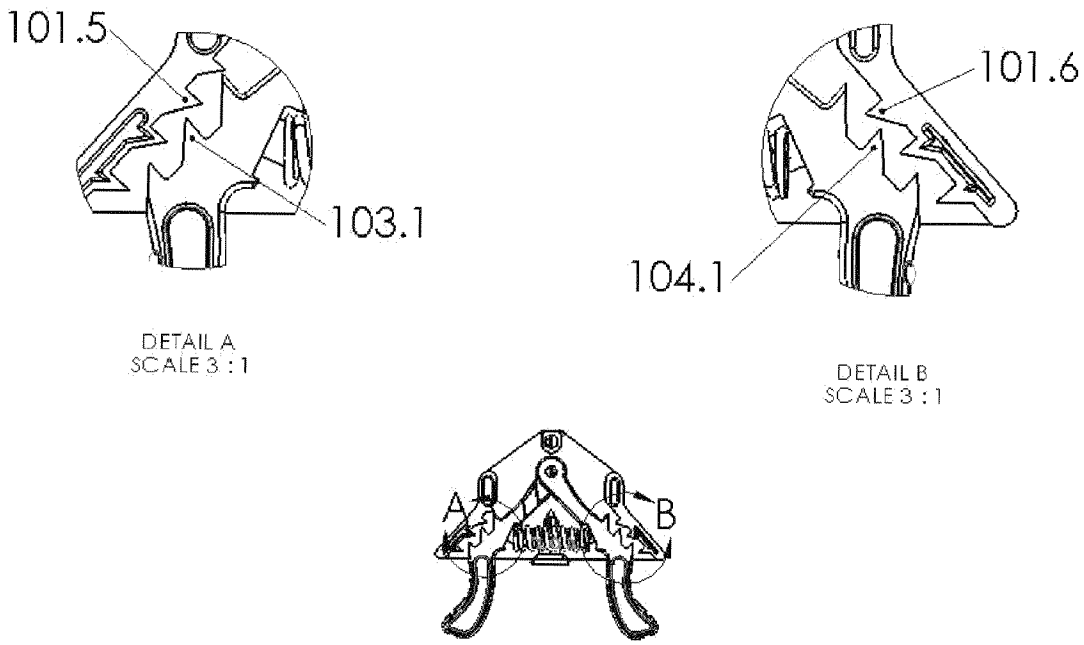
FIG. 4B is an alternative configuration of the teeth alignment between the arm and the base.

In FIG. 4B by contrast, the drawing demonstrates the teeth orientation between the arm and the base but in various orientations. The drawing at Detail A is zoomed in a scale of 3:1 to show the detail of another configuration between the arm teeth (103.1) and the base teeth (101.5). In this configuration, the teeth are aligned to prevent the downward motion of the lace but the teeth are oriented point-to-point. This locks well but can knot the lace. The drawing at Detail B is zoomed in a scale of 3:1 to show the detail of yet another configuration between the arm teeth (104.1) and the base teeth (101.6). In this configuration, the teeth are aligned once again to prevent the downward motion of the lace but the points are staggered. This design may still knot the lace with the point directly at the ramped surface. These are just a few examples of how the teeth may be oriented and this patent design can be configured in these examples or many variations thereof.

The claims for this patent are as follows:

1. A locking member for releasably clamping two end portions of a lace, comprising:

a wedge-shaped housing including a central cavity having first and second ends, two opposite sides of the housing each having a wall laterally spaced from one another and defining the central cavity, each wall having an inner side surface, and each inner side surface having teeth;

two identical overlapping arms pivotally fixed on a lever post within the second end of the cavity and spring-biased via a coil spring at the first end of the cavity, each arm having a portion extending out of the cavity at one of the first end and the second end, forming a handle portion, each arm having an outer side surface, and each outer side surface having teeth facing the respective teeth of the inner side surfaces;

the inner side surfaces of the walls and the outer side surfaces of the arms form two channels at opposite sides of the central cavity which are adapted to receive the two lace end portions;

the teeth of the respective inner and outer side surfaces within the two channels are aligned in a zig-zag manner and are oriented to allow one direction of motion of the lace end portions through the channels while deterring movement of the lace end portions in the opposite direction when the two arms are spring-biased toward the walls of the housing thereby engaging the lace end portions; and wherein squeezing the handle portions together against the bias of the coil spring allows disengagement of the lace end portions from the respective teeth within their respective channel for removal of the lace end portions from the channels.

2. The locking member of claim 1, wherein each of the handle portions have a length extending from the cavity which provides a mechanical advantage to disengage the locking member from the lace end portions.

3. The locking member of claim 1, wherein the locking member is operable by a single hand of a user, allowing the arms to be squeezed together and the locking member to be slid to a desired position along the lace end portions in a single motion.

4. The locking member of claim 1, wherein the channels converge from the first end of the housing to the second end of the housing, forming an angle therebetween.

5. The locking member of claim 1, wherein the handle portion of each arm has a curved contour to accommodate the grip of a user.

6. The locking member of claim 1, wherein the housing is made of plastic.

7. The locking member of claim 1, wherein the spring is made of stainless steel.

8. The locking member of claim 1, wherein the spring has a length of 1 inch and an outer diameter of 0.180 inch, providing a maximum compressed force of 3.3lbs.

* * * * *